US006743295B2

(12) United States Patent
Keller et al.

(10) Patent No.: US 6,743,295 B2
(45) Date of Patent: Jun. 1, 2004

(54) COMPARTMENT FOR POWDER COATING OF WORKPIECES

(75) Inventors: Christoph Keller, Hauptwil (CH); Hans Mendler, Abtwil (CH)

(73) Assignee: J. Wagner AG, Alstatten (CH)

( * ) Notice: Subject to any disclaimer, the term of this patent is extended or adjusted under 35 U.S.C. 154(b) by 47 days.

(21) Appl. No.: 10/081,544

(22) Filed: Feb. 20, 2002

(65) Prior Publication Data

US 2002/0166506 A1 Nov. 14, 2002

(30) Foreign Application Priority Data

May 8, 2001 (DE) ..... 201 07 767 U

(51) Int. Cl.[7] ..... B05B 15/12

(52) U.S. Cl. ..... 118/309; 118/66; 118/326; 118/DIG. 7

(58) Field of Search ..... 118/309, 308, 118/326, 66, DIG. 7; 454/50

(56) References Cited

U.S. PATENT DOCUMENTS

| | | | | |
|---|---|---|---|---|
| 3,402,697 A | | 9/1968 | Kock | |
| 4,231,289 A | * | 11/1980 | Domicent | 118/326 |
| 5,023,116 A | * | 6/1991 | Williams et al. | 118/326 |
| 5,060,860 A | | 10/1991 | Megerle | |
| 5,078,084 A | * | 1/1992 | Shutic et al. | 118/309 |
| 6,063,195 A | | 5/2000 | Giesinger et al. | |
| 6,187,098 B1 | * | 2/2001 | Kramer et al. | 118/309 |
| 6,589,345 B2 | * | 7/2003 | Gelain | 118/309 |

FOREIGN PATENT DOCUMENTS

| | | |
|---|---|---|
| DE | 29 45 934 A1 | 5/1980 |
| DE | 33 40 510 A1 | 5/1985 |
| DE | 37 21 875 A1 | 1/1989 |
| DE | 44 06 046 A1 | 8/1995 |
| DE | 195 24 327 A1 | 4/1996 |
| DE | 44 43 859 A1 | 6/1996 |
| DE | 195 02 741 A1 | 7/1996 |
| DE | 196 50 112 C1 | 5/1998 |
| JP | 58-151517 A | 12/1983 |
| JP | 3-125924 | 5/1991 |

OTHER PUBLICATIONS

W. Kleber et al, "Überwachung und Steuerung", I–Lack 4/89, pp. 137.

* cited by examiner

*Primary Examiner*—Richard Crispino
*Assistant Examiner*—Yewebdar Tadesse
(74) *Attorney, Agent, or Firm*—Fenwick & West LLP

(57) ABSTRACT

A compartment for powder coating workpieces conveyed through an aperture for the workpieces formed in an end wall and coated by means of automatic coating equipment inside the compartment in which there is negative pressure comprises at least one manual coating station located beyond and adjacent the aperture, as seen in conveying direction of the workpieces for manually coating workpieces outside of the compartment. In this manner, on the one hand, openings in the sidewalls of the compartment for manual coating of the workpieces from the side of the compartment can be dispensed with and, on the other hand, practically unlimited free space is offered during manual coating.

7 Claims, 5 Drawing Sheets

COMPARTMENT FOR POWDER COATING OF WORKPIECES

FIELD OF THE INVENTION

The invention relates to a compartment for powder coating workpieces.

BACKGROUND OF THE INVENTION

Such compartments have been known and used for a long time. The interior of the compartments is limited by sidewalls, end walls at both ends, a compartment floor, and a compartment roof which is divided by a longitudinal gap. Usually the workpieces are moved through this longitudinal gap by means of a conveyor. To permit such conveyance, the compartment has an aperture for workpieces at least in its upstream end wall. Often a manual coating station is provided next to the compartment at the side thereof and adjacent the upstream end wall. There is an opening in the sidewall of the compartment that belongs to this manual coating station. Through the opening an operator can prime areas of the workpiece which are difficult to coat or need a prime coat by manipulating a hand spray gun inside the compartment and upstream of the automatic coating, in conveying direction of the workpieces. If desired or required, a second manual coating station is provided, likewise laterally of the compartment, downstream of the automatic coating of the workpieces, in conveying direction of the workpieces. Any insufficiently coated and/or complicated areas of the workpieces thus may be recoated manually, as needed, inside the compartment by a person acting from this other manual coating station.

The free space is limited when manipulating the hand spray guns since the manual coating must be accomplished in the interior of the compartment through openings in the compartment.

During the coating operation powder particles may escape to the outside through the rather great openings at the manual coating stations, causing harm to the environment and loss of powder. This disadvantageous effect might be compensated by reinforcing the vacuum which prevails inside the compartment. That would bring about a corresponding increase of the suction effect and alter the flow conditions inside the compartment to such a degree that the coating quality would suffer.

Moreover, lighting conditions inside the compartment are not sufficient to allow accurate manual working. For this reason lamps are provided in the known compartment at the location of the manual coating stations to illuminate the workpieces at the locations of the respective manual coating stations, more specifically in the sidewall next to the openings provided for the manual coating stations so that the workpieces are illuminated from the front. In operation these lamps become contaminated very fast by deposits of excess powder.

SUMMARY OF THE INVENTION

It is an object of the invention to design a compartment of the kind defined initially such that the escape of powder particles into the environment of the compartment is reduced while unobstructed, high-quality manual coating still can be achieved economically, i.e. especially, without increasing the suction effect.

Other than in the prior art, the workpieces are pre- and/or re-coated outside of the compartment at a manual coating station which, according to the invention, is located upstream or downstream of the compartment in conveying direction. Thus the person doing the manual coating inherently is offered practically unlimited free space for careful manual coating, as would not be available even with very large lateral openings for manual coating in the state of the art. This is possible without any extra expenditure while, at the same time, achieving superior manual coating quality.

Daylight or the workshop lighting which is installed anyway may be sufficient to illuminate the portions to be coated. In addition, lamps may be mounted at the outside of the compartment for illumination of the coating places. In this manner the unavoidable illumination in the interior of the compartment may be realized in the form of lighting fixtures in the ceiling, in other words at a location which is not sensitive to contamination.

The preferred arrangement of the respective manual coating station near the aperture which always is kept open during operation makes sure that practically none of the powder sprayed when manually coating workpieces gets lost to the environment. The negative pressure inside the compartment has the effect of any excess powder which does not reach the workpiece being sucked through the aperture into the compartment.

Further advantageous modifications of the invention are protected by the other subclaims.

BRIEF DESCRIPTION OF THE DRAWINGS

The invention will be described further, by way of example, with reference to the accompanying diagrammatic drawings, in which.

DETAILED DESCRIPTION OF THE INVENTION

Figure 1:
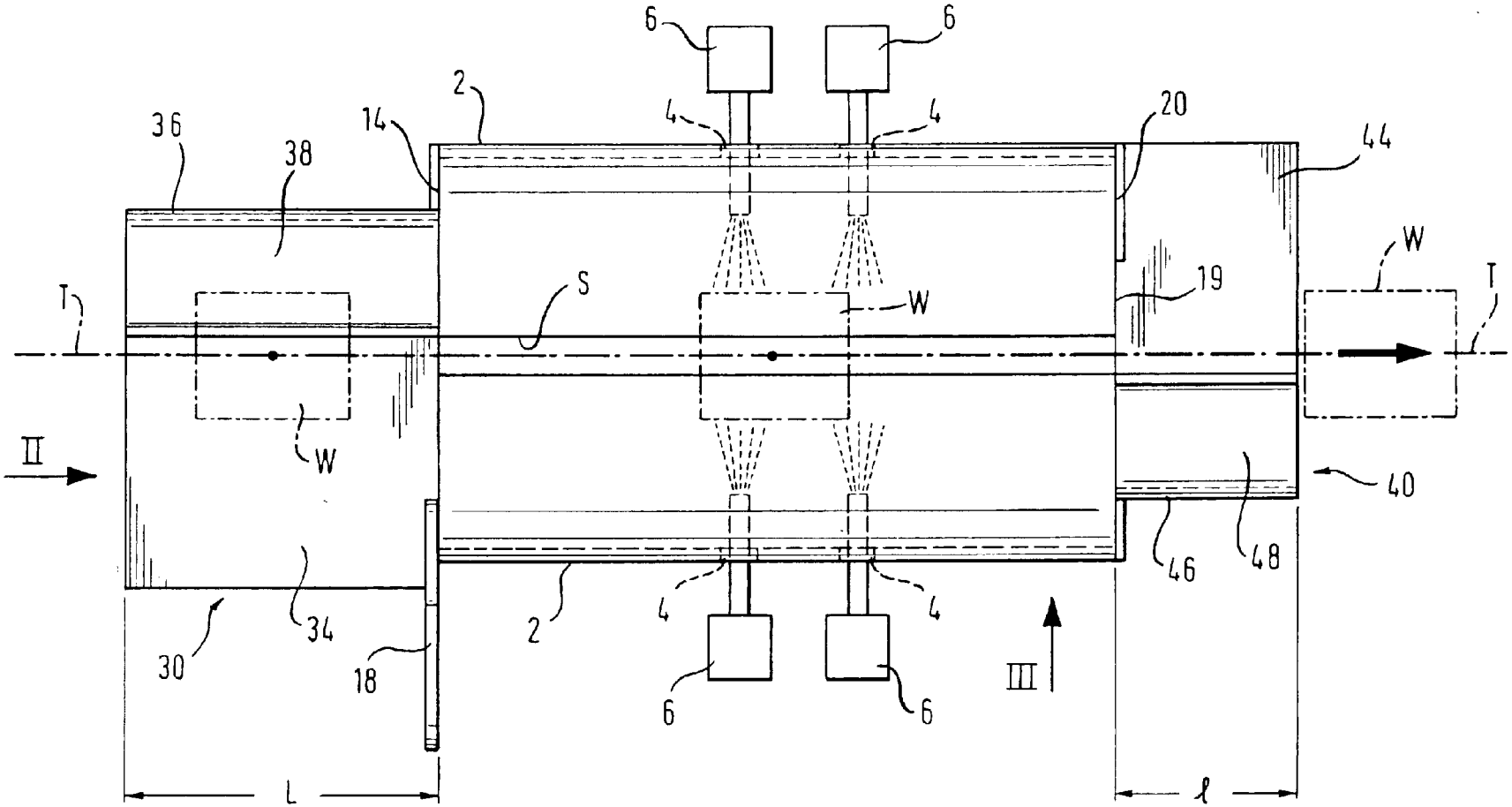
FIG. 1 is a top plan view of a compartment according to the invention.

The compartment illustrated in the drawings serves for coating of workpieces W, indicated in dash-dot lines, which are moved continuously or in stepwise fashion through the compartment in the direction of the respective arrow along a conveying direction or path T, likewise drawn in dash-dot lines. The compartment has two sidewalls 2 formed with oblong vertical holes 4 to permit passage of vertically movable automatic powder spray guns 6 indicated in FIG. 1.

The compartment further comprises a compartment roof 8 divided by a longitudinal gap S which allows suspension devices 10 for the workpieces W to be passed through in order to permit the suspension devices 10 with the workpieces W suspended from them to be conveyed through the compartment along the conveying path T.

Figure 2:
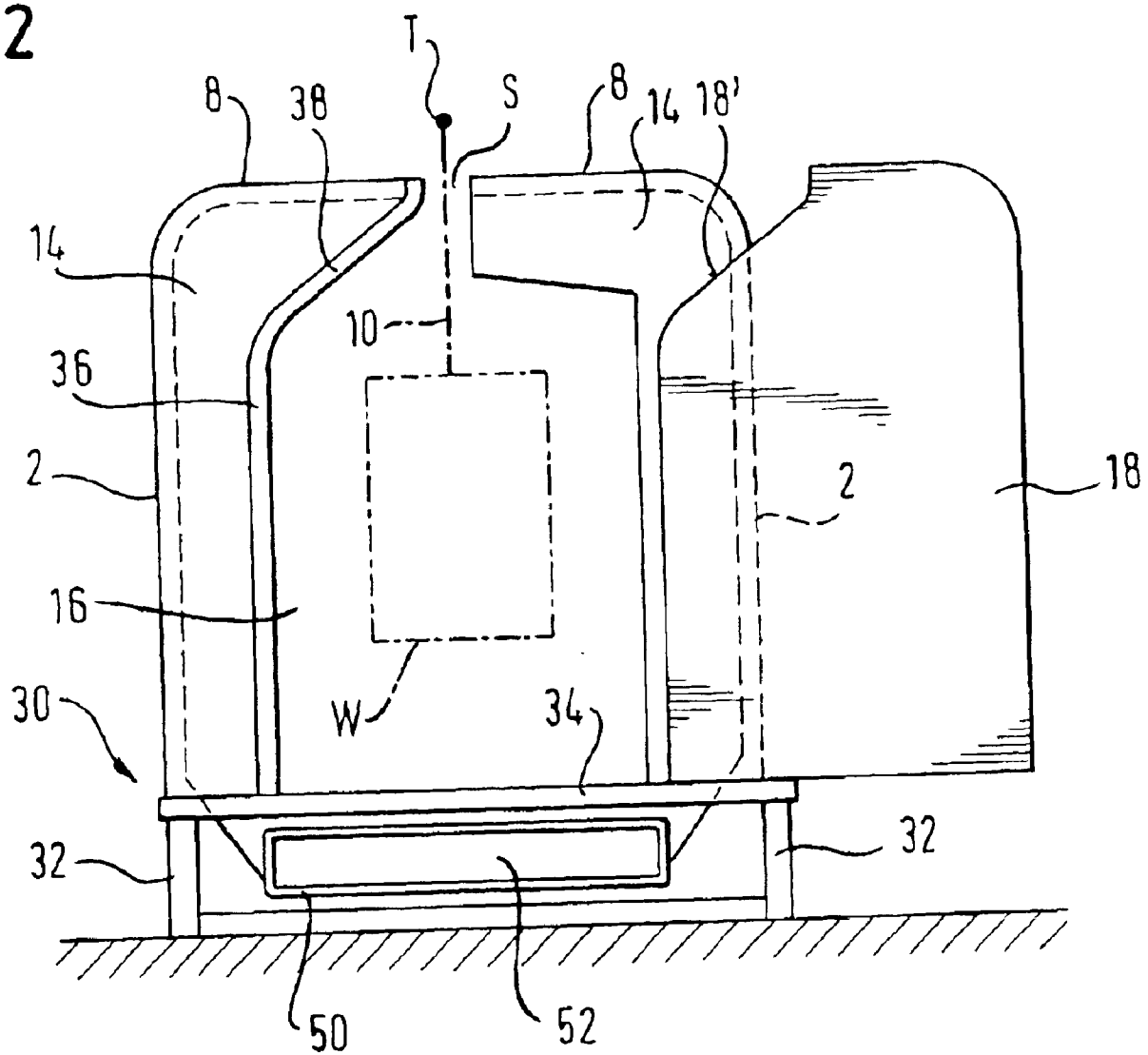
FIG. 2 is a front end view of the compartment shown in FIG. 1, as seen in the direction of arrow II in FIG. 1.
Figure 3:
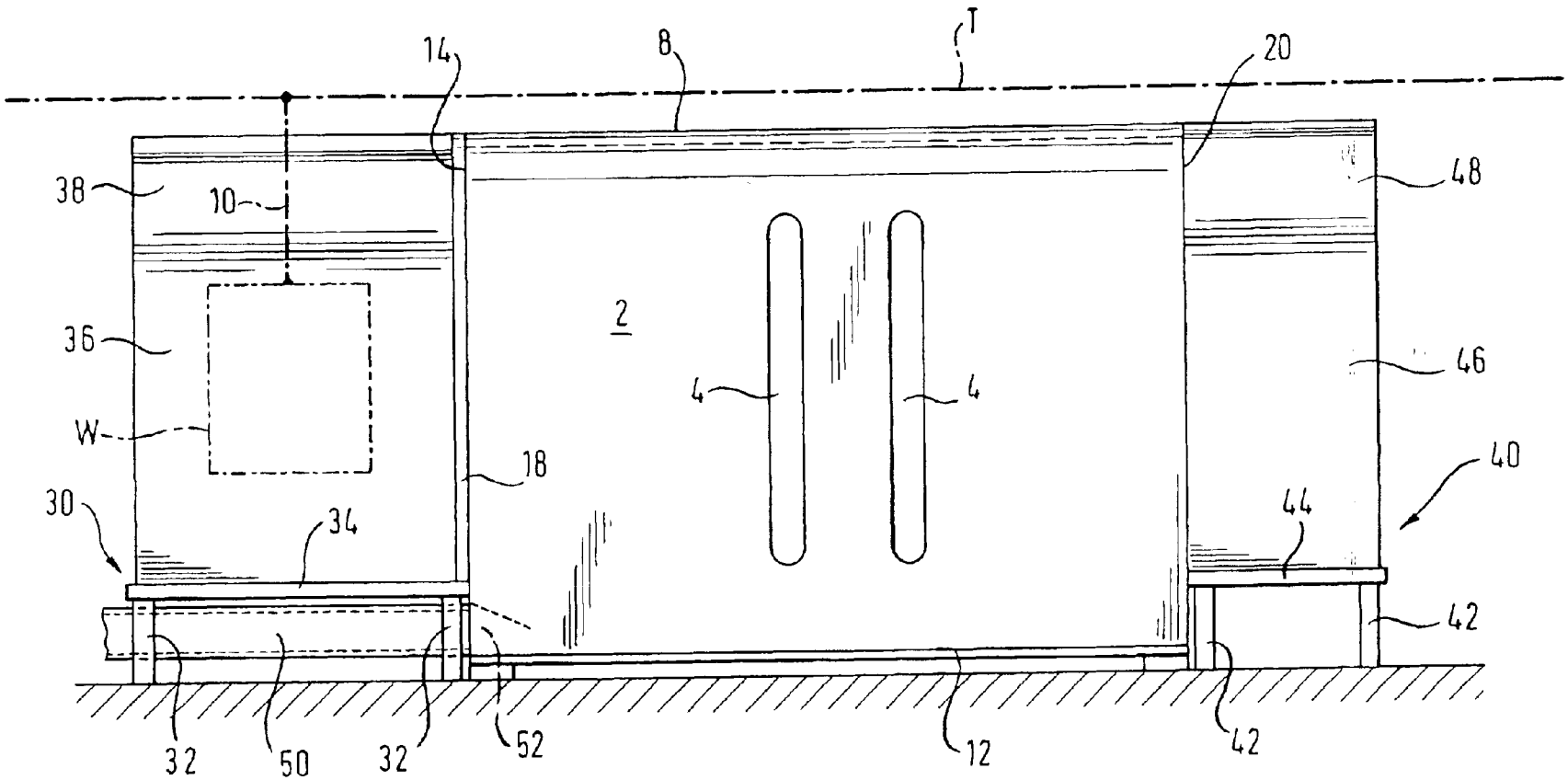
FIG. 3 is a side elevation of the compartment shown in FIGS. 1 and 2, as seen in the direction of arrow III in FIG. 1.

The compartment further has a floor 12 and a front end wall 14, both disposed at the left end of the compartment as seen in FIGS. 1 and 3, and a rear end wall 20 at the right end of the compartment, as seen in FIGS. 1 and 3. The end wall 14 has an aperture 16 distinctly larger than the transverse profile of the workpieces W (see FIG. 2). This aperture 16 can be closed for cleaning operations by a sliding door 18 which permits access to the walkable interior of the compartment.

The rear end wall 20 has an aperture 19 which, just like the aperture 16, may have dimensions that allow passage of the workpieces W to leave the compartment. A door may be missing here, especially if provision is made for suction near the front end wall 14.

A manual coating station, generally indicated by reference numeral 30, is arranged so as to be contiguous with the end wall 14. It comprises a walkable standing floor 34 supported on legs 32 and positioned higher than the floor 12 of the compartment. As it has no wall at the right hand side of the conveying path, as seen in FIG. 2, it is freely accessible. At the left hand side in FIG. 2 there is a rear wall 36 which is bent in its upper region to form a partial roof cover 38 of the manual coating station, extending parallel to the conveying path T all the way up to the left edge, in FIG. 2, of the gap S for passage of the suspension devices 10 for the workpieces W. The partial roof cover may be realized in four different configurations as shown in FIGS. 5*a* to 5*d*. In its upper part 18', on the left hand side in FIG. 2, the sliding door 18 is shaped so as to conform to the profile of the partial roof cover 38. As the outline of the sliding door 18 is adapted to that of the rear wall 36 and of the partial roof cover 38 an inserted seal 39 (FIGS. 5*a*) to 5*d*)) will provide optimum cleaning efficiency when the sliding door 18 is closed.

Figure 4:
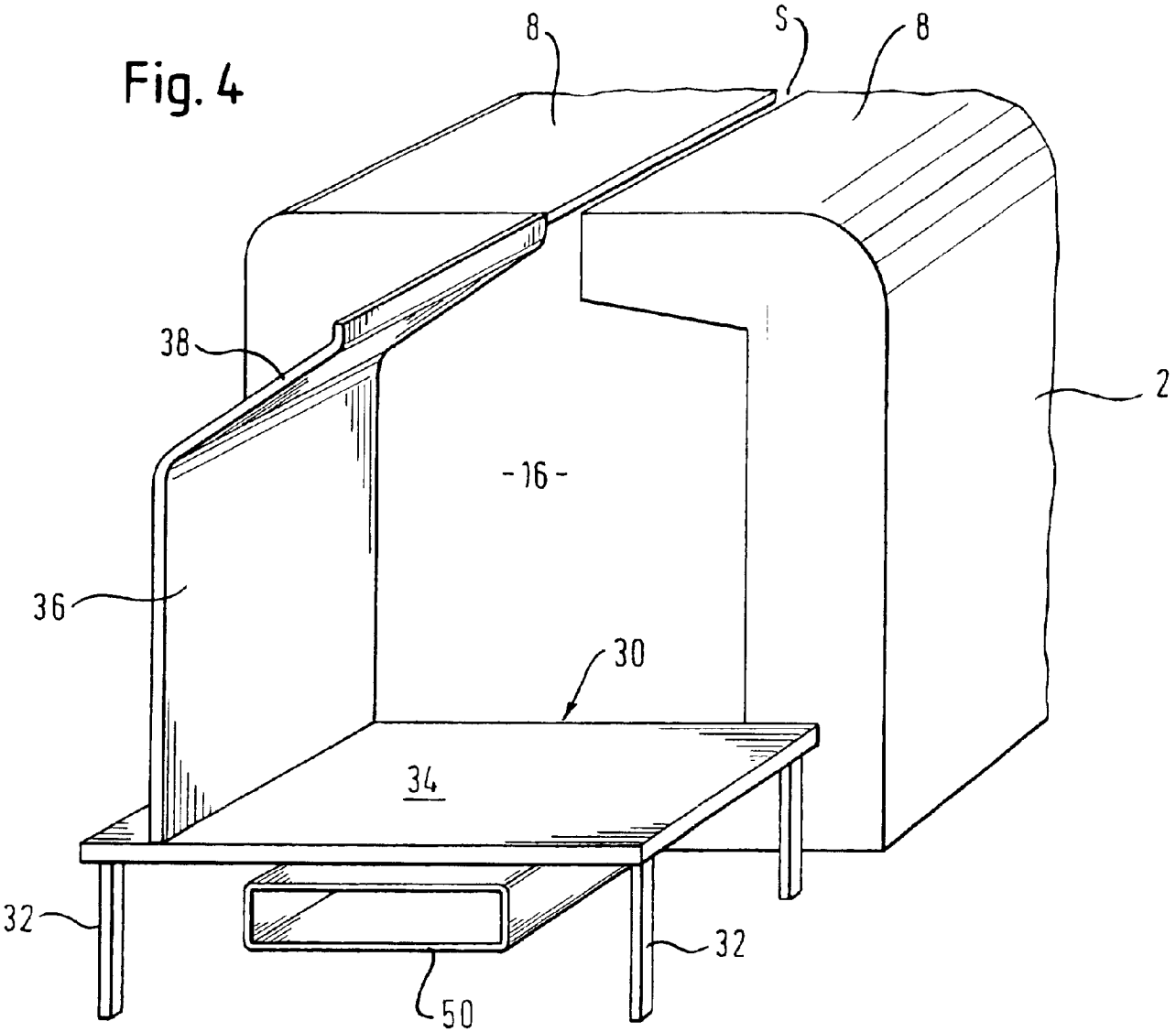
FIG. 4 is a perspective view of the upstream end of the compartment, including a manual coating station designed and arranged according to the invention.
Figure 5:
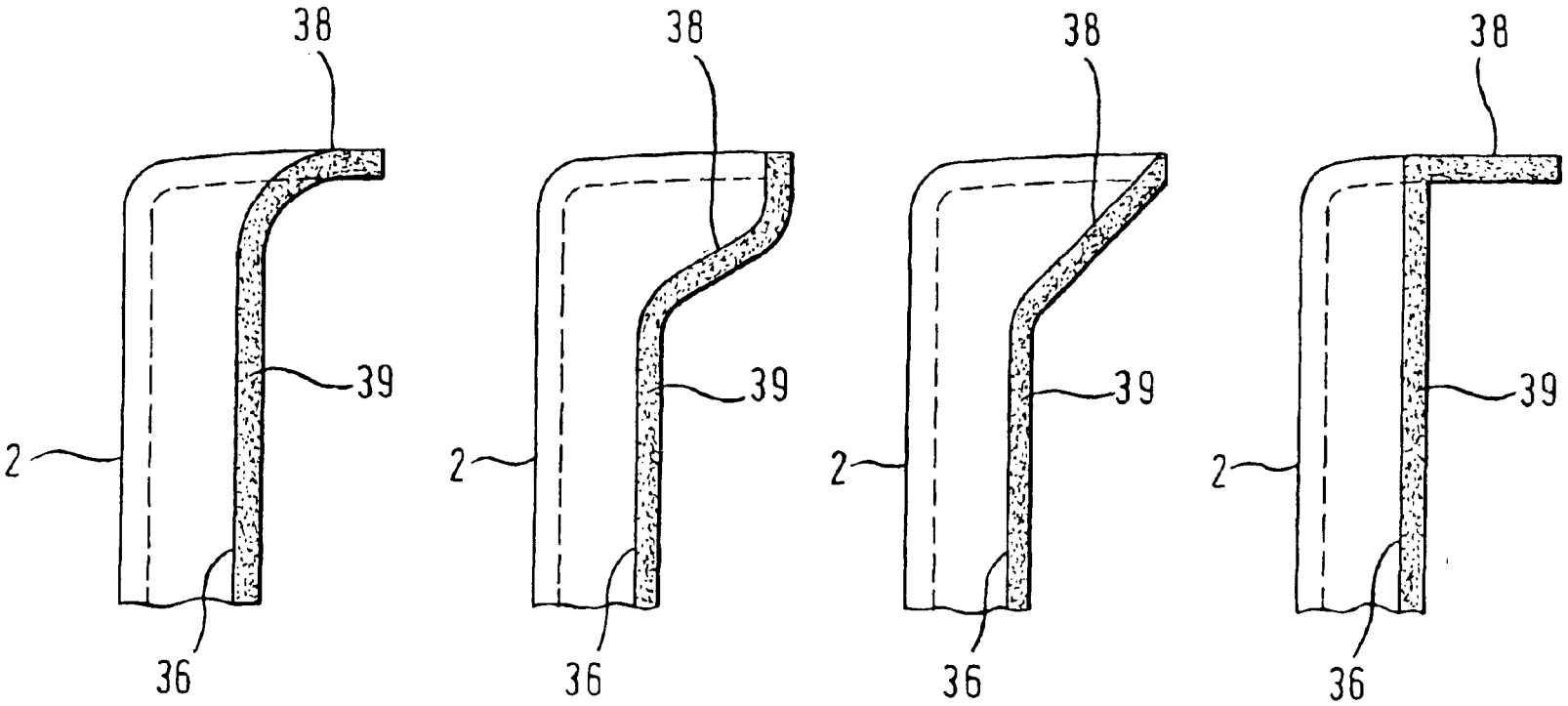
FIG. 5 illustrate four design examples for the rear wall of a manual coating station according to the invention, each showing a partial section transversely of the conveying direction of the workpieces into the compartment.

As may be taken from FIGS. 2, 3, and 4, a suction line 50 extending under the standing floor 34 is connected to an opening 52 formed in the front end wall 14 of the compartment. The suction line 50 is connected to a filtering or recovering unit (not shown) for excess powder.

A second manual coating station 40 is disposed directly adjacent the end wall 20 downstream of the compartment. It comprises a standing floor 44 resting on legs 42 and is accessible from the opposite side of manual coating station 30, likewise having a rear wall 46 with a bent partial roof cover 48. Instead of communicating through the opening 52 in the front end wall, the suction line 50 also might be connected to the interior of the compartment through an opening below the standing floor 44 in the rear end wall 22. In the example illustrated in FIG. 1 the manual coating station 30 has a greater dimension L in conveying direction T than the corresponding dimension 1 of the manual coating station 40 because the suction effect through the aperture 16 into the compartment is greater near the suction opening 52 than the suction effect through the aperture 19. At this end of the compartment, therefore, the operator can do the coating at a greater distance from the aperture than at the other end of the compartment and consequently has more available free space.

Preferably at least walls 2, 14, and 20 of the compartment and the compartment roof 8 are made of a material which is not electrically conductive.

During operation of the compartment workpieces W are conveyed through the compartment from left to right, as seen in FIG. 2, either continuously or stepwise. At the same time that automatic coating takes place in the interior of the compartment by means of the automatic spray guns 6, a person standing or sitting on the standing floor 34 does the precoating of critical places of a workpiece W which still is outside of the compartment. In the same manner another person doing manual coating can perform this work at the manual coating station 40 on workpieces W which are leaving the compartment and have received a faulty or incomplete coating. The workers have practically unlimited free space outside of the interior of the compartment to manipulate their spray guns for manual coating. And it may be possible to illuminate the workpieces at the places to be coated by means of lamps mounted on the outside of the compartment roof.

The suction acting towards the interior of the compartment at the apertures 16 and 19, respectively, in the respective end walls 14, 20 draws excess powder which does not reach the respective workpieces W during manual coating into these apertures.

What is claimed is:

1. A compartment for powder coating workpieces (W) which are conveyed through an aperture for the workpieces in an end wall and coated automatically inside the compartment in which negative pressure can be generated, a manual coating station being arranged outside of the compartment and adjacent an upstream first aperture as seen in conveying direction (T) of the workpieces (W), and wherein another manual coating station is provided downstream of a second aperture for the workpieces (W) in a second end wall of the compartment.

2. The compartment as claimed in claim 1, wherein each aperture is adapted to be closed by a door for cleaning of the compartment.

3. The compartment as claimed in claim 1, wherein each manual coating station comprises a standing floor and a rear wall disposed parallel to the conveying direction (T) of the workpieces, and wherein the standing floor is freely accessible from the side opposite the rear wall.

4. The compartment as claimed in claim 3, wherein a suction line opens into the interior of the compartment by a suction opening in the end wall below the standing floor.

5. The compartment as claimed in claim 4, wherein the manual coating station (30) located adjacent the end wall (14) which is formed with the suction opening (52) has a greater dimension (L) in conveying direction (T).

6. The compartment as claimed in claim 3, wherein a partial roof cover of each manual coating station is integrated with the rear wall, leaving free the conveying direction (T) for the workpieces (W) into and through the compartment.

7. The compartment as claimed in claim 1, wherein lamps are mounted on the outside of the compartment to illuminate the coating place of each manual coating station.

* * * * *